US009496084B2

(12) United States Patent
Han et al.

(10) Patent No.: US 9,496,084 B2
(45) Date of Patent: Nov. 15, 2016

(54) METHOD OF MANUFACTURING CHIP ELECTRONIC COMPONENT

(71) Applicant: SAMSUNG ELECTRO-MECHANICS CO., LTD., Suwon-Si, Gyeonggi-Do (KR)

(72) Inventors: Jin Ok Han, Suwon-Si (KR); Tae Young Kim, Suwon-Si (KR); Moon Soo Park, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 93 days.

(21) Appl. No.: 14/296,178

(22) Filed: Jun. 4, 2014

(65) Prior Publication Data

US 2015/0255206 A1 Sep. 10, 2015

(30) Foreign Application Priority Data

Mar. 7, 2014 (KR) ..... 10-2014-0027292

(51) Int. Cl.

*H01F 41/04* (2006.01)
*H01F 27/28* (2006.01)
*H01F 27/29* (2006.01)

(Continued)

(52) U.S. Cl.

CPC ..... *H01F 41/041* (2013.01); *H01F 17/0013* (2013.01); *H01F 27/2804* (2013.01);

(Continued)

(58) Field of Classification Search

CPC . H01L 41/024; H01L 41/041; H01L 41/046; H01L 27/2804; H01L 27/2809; H01L 27/29; H01L 27/292; H01L 27/306; H01L 17/0013; Y10T 29/4902; Y10T 29/49073; H01F 41/024; H01F 41/041; H01F 41/046; H01F 27/2804; H01F 2027/2809; H01F 27/29; H01F 27/292; H01F 27/306; H01F 17/0013

See application file for complete search history.

(56) References Cited

U.S. PATENT DOCUMENTS

2005/0105225 A1* 5/2005 Ahn ..... H01F 41/046 361/18
2006/0084277 A1* 4/2006 Nakashima ..... H01L 21/02282 438/758
2013/0082812 A1* 4/2013 Yoo ..... H01F 41/046 336/200

FOREIGN PATENT DOCUMENTS

JP 2005-210010 A 8/2005
JP 2006-210541 A 8/2006

(Continued)

OTHER PUBLICATIONS

Machine (English) Translation of Japanese Patent Publication, JP 2006-202880, Mar 2016.*
Machine (English) Translation of Japanese Patent Publication, JP 2006-261586, Mar 2016.*

*Primary Examiner* — A. Dexter Tugbang
(74) *Attorney, Agent, or Firm* — McDermott Will & Emery LLP

(57) ABSTRACT

The manufacturing method of a chip electronic component may include: forming a coil pattern part on at least one surface of an insulating substrate; forming a thin polymer insulating film to follow a surface shape of the coil pattern part; forming a primer insulating layer on one surface of a magnetic sheet; disposing the magnetic sheet on which the primer insulating layer is formed on an upper portion and a lower portion of the insulating substrate on which the coil pattern part is formed and pressing the magnetic sheet to form a magnetic body in which an additional insulating film is formed on the coil pattern part; and forming an external electrode on at least one end surface of the magnetic body so as to be connected to the coil pattern part.

11 Claims, 4 Drawing Sheets

(51) Int. Cl.
*H01F 41/02* (2006.01)
*H01F 17/00* (2006.01)
*H01F 27/30* (2006.01)

(52) U.S. Cl.
CPC ..... *H01F27/29* (2013.01); *H01F 27/292* (2013.01); *H01F 27/306* (2013.01); *H01F 41/024* (2013.01); *H01F 41/046* (2013.01); *H01F 2027/2809* (2013.01); *Y10T 29/4902* (2015.01); *Y10T 29/49073* (2015.01)

(56) References Cited

FOREIGN PATENT DOCUMENTS

| | | | | |
|---|---|---|---|---|
| JP | 2006202880 | A | * | 8/2006 |
| JP | 2006261586 | A | * | 9/2006 |
| JP | 2008-166455 | A | | 7/2008 |
| JP | 2013-161939 | A | | 8/2013 |

* cited by examiner

METHOD OF MANUFACTURING CHIP ELECTRONIC COMPONENT

CROSS-REFERENCE TO RELATED APPLICATION

This application claims the benefit of Korean Patent Application No. 10-2014-0027292 filed on Mar. 7, 2014, with the Korean Intellectual Property Office, the disclosure of which is incorporated herein by reference.

BACKGROUND

The present disclosure relates to a chip electronic component and a manufacturing method thereof.

An inductor, which is one of chip electronic components, is a typical passive element forming an electronic circuit together with a resistor and a capacitor to remove noise. Such an inductor may be combined with the capacitor using electromagnetic characteristics to configure a resonance circuit amplifying a signal in a specific frequency band, a filter circuit, or the like.

Recently, as the trend for the miniaturization and thinning of Information Technology (IT) devices such as various communications devices, display devices, and the like, has grown, research into technologies for miniaturizing and thinning various elements such as inductors, capacitors, transistors, and the like, used in the IT devices, has been continuously undertaken. The inductor has also been rapidly replaced by a chip having a small size and high density and capable of being automatically surface-mounted, and the development of a thin type inductor formed by mixing a magnetic powder with a resin and applying the mixture to coil patterns formed on upper and lower surfaces of a thin film insulating substrate through plating has been conducted.

According to the thin type inductor described above, the coil patterns are formed on the insulating substrate and an insulating layer is then formed thereon to prevent contact between the coil patterns and an external magnetic material.

However, in a case in which an insulating material is formed by a lamination method, or the like, according to the related art, a sufficient width of the insulating layer is required in order to form the insulating layer to a lower portion of the coil. Since a volume occupied by an external magnetic material is decreased in accordance with an increase in the width of the insulating layer, defects such as a decrease in inductance of the inductor, or the like may be caused.

Therefore, the development of the thin type inductor has been made in such a manner that a thickness of the insulating layer is reduced to increase inductance. However, in the case of applying a method of forming an insulating layer at a minimum thickness, a non-insulating region of the coil may be formed.

Due to formation of the non-insulating region as described above, a leakage current may be generated by direct contact between a metal magnetic material, or the like, which is a magnetic raw material, and the coil pattern. Therefore, due to the generation of the leakage current, normal inductance may be present at a frequency of 1 MHz, but may be rapidly decreased under high frequency conditions, thereby occurring a defective waveform.

Therefore, according to the related art, a separate additional insulating process for preventing a non-insulation defect of the coil is performed, but there are problems in that the process is complicated, workability is deteriorated, and improvements in the defect are insignificant.

RELATED ART DOCUMENT (Patent Document 1) Japanese Patent Laid-Open Publication No. 2005-210010
(Patent Document 2) Japanese Patent Laid-Open Publication No. 2008-166455

SUMMARY

An aspect of the present disclosure may provide a chip electronic component capable of decreasing a non-insulation defect caused by formation of a thin insulating layer without a separate additional insulating process to prevent a defective waveform at high frequency and increasing inductance of an inductor, or the like, and a manufacturing method thereof.

According to an aspect of the present disclosure, a manufacturing method of a chip electronic component may include: forming a coil pattern part on at least one surface of an insulating substrate; forming a coil pattern part on at least one surface of an insulating substrate; forming a thin polymer insulating film to follow a surface shape of the coil pattern part; forming a primer insulating layer on one surface of a magnetic sheet; disposing the magnetic sheet on which the primer insulating layer is formed on an upper portion and a lower portion of the insulating substrate on which the coil pattern part is formed and pressing the magnetic sheet to form a magnetic body in which an additional insulating film is formed on the coil pattern part; and forming an external electrode on at least one end surface of the magnetic body so as to be connected to the coil pattern part.

The additional insulating film may be formed to follow the surface shape of the coil pattern part on the thin polymer insulating film.

The additional insulating film may be formed to cover the entirety of the coil pattern part on which the thin polymer insulating film is formed.

The thin polymer insulating film may be formed by a chemical vapor deposition (CVD) method.

The thin polymer insulating film may contain one or more selected from a group consisting of poly(p-xylylene), an epoxy resin, a polyimide resin, a phenoxy resin, a polysulfone resin, and a polycarbonate resin.

The primer insulating layer may contain one or more selected from a group consisting of an epoxy resin, a polyimide resin, a phenoxy resin, a polysulfone resin, and a polycarbonate resin.

The primer insulating layer may contain a filler.

The thin polymer insulating film may be formed to have a thickness of 1 μm to 3 μm.

The primer insulating layer may have a thickness of 1 μm to 5 μm.

A magnetic material may fill a region between coil portions of the coil pattern part on which the thin polymer insulating film and the additional insulating film are formed.

According to another aspect of the present disclosure, a chip electronic component may include: a magnetic body including an insulating substrate; a coil pattern part formed on at least one surface of the insulating substrate; insulating films formed on a surface of the coil pattern part; and an external electrode formed on at least one end surface of the magnetic body and connected to the coil pattern part, wherein the insulating films include a thin polymer insulating film formed on the surface of the coil pattern part to follow a surface shape of the coil pattern part and an additional insulating film formed to follow the surface shape of the coil pattern part on the coil pattern part on which the thin polymer insulating film is formed.

The additional insulating film may be formed to cover the entirety of the coil pattern part on which the thin polymer insulating film is formed.

The thin polymer insulating film may contain one or more selected from a group consisting of poly(p-xylylene), an epoxy resin, a polyimide resin, a phenoxy resin, a polysulfone resin, and a polycarbonate resin.

The additional insulating film may contain one or more selected from a group consisting of an epoxy resin, a polyimide resin, a phenoxy resin, a polysulfone resin, and a polycarbonate resin.

The additional insulating film may contain a filler.

The thin polymer insulating film may be formed to have a thickness of 1 μm to 3 μm.

The additional insulating film may have a thickness of 1 μm to 5 μm.

A magnetic material may fill a region between coil portions of the coil pattern part on which the thin polymer insulating film and the additional insulating film are formed.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
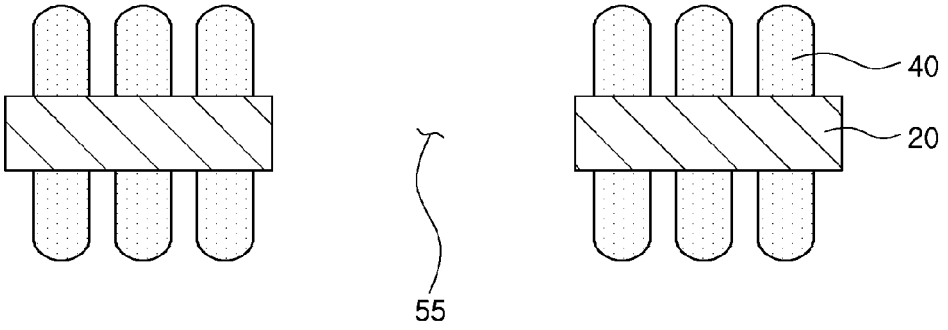
FIGS. 1 through 4 are views sequentially showing a manufacturing method of a chip electronic component according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Manufacturing Method of Chip Electronic Component

FIGS. 1 through 4 are views sequentially showing a manufacturing method of a chip electronic component according to an exemplary embodiment of the present disclosure.

Referring to FIG. 1, first, a coil pattern part 40 may be formed on at least one surface of an insulating substrate 20.

The insulating substrate 20 is not particularly limited. For example, as the insulating substrate 20, a polypropylene glycol (PPG) substrate, a ferrite substrate, a metal-based soft magnetic material, or the like, may be used, and the insulating substrate 20 may have a thickness of 40 to 100 μm.

As a method for forming the coil pattern part 40, for example, an electroplating method may be used, but the present disclosure is not limited thereto. The coil pattern part 40 may be formed of a metal having excellent electrical conductivity. For example, silver (Ag), palladium (Pd), aluminum (Al), nickel (Ni), titanium (Ti), gold (Au), copper (Cu), or platinum (Pt), a mixture thereof, or the like, may be used.

A via electrode 45 may be formed by forming a hole in a portion of the insulating substrate 20 and filling the hole with a conductive material, such that the coil pattern part 40 formed on one surface of the insulating substrate 20 and the coil pattern part 40 formed on the other surface of the insulating substrate 20 may be electrically connected to each other through the via electrode 45.

A through hole 55 penetrating through the insulating substrate 20 may be formed in a central portion of the insulating substrate 20 by performing a drilling process, a laser process, a sandblasting process, or a punching process, or the like, on the central portion of the insulating substrate 20.

Figure 2:
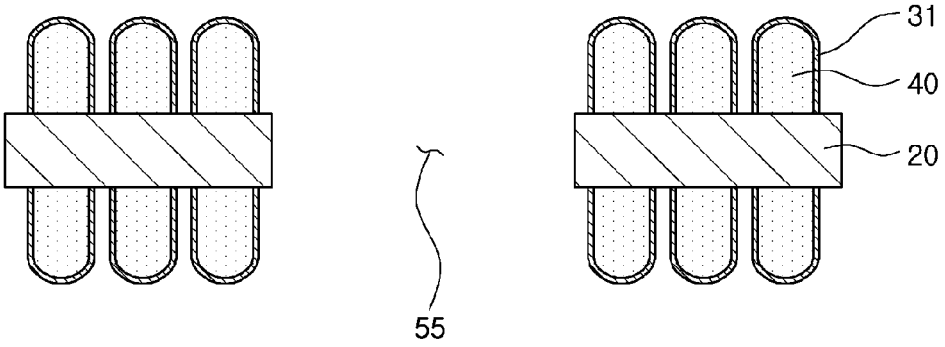

Referring to FIG. 2, a thin polymer insulating film 31 may be formed on the coil pattern part 40 to follow a surface shape of the coil pattern part 40.

The thin polymer insulating film 31 may be formed by a chemical vapor deposition (CVD) method or a dipping method using a low viscosity polymer coating solution.

In a case in which the insulating film is formed by the CVD method or the dipping method using a low viscosity polymer coating solution, a surface of the formed thin polymer insulating film 31 may be thinly formed to follow the surface shape of the coil pattern part 40.

In the case of applying the CVD method, the thin polymer insulating film 31 may be formed using a compound in which dimers are present in a vapor phase at 120° C. to 180° C. and pyrolyzed into monomers at 650° C. to 700° C. For example, poly(p-xylylene) may be used.

As a polymer used in the dipping method using a low viscosity polymer, any polymer may be used as long as the polymer may form a thin insulating film. For example, an epoxy resin, a polyimide resin, a phenoxy resin, a polysulfone resin, a polycarbonate resin, or the like, may be used alone, or a combination thereof may be used.

The thin polymer insulating film 31 may be formed to have a thickness of 3 μm or less, more preferably 1 μm to 3 μm.

In a case in which the thickness of the formed thin polymer insulating film 31 is less than 1 μm, the insulating film may be damaged during a disposing and pressing process of a magnetic layer, such that a defective waveform may occur due to contact between the coil pattern part 40 and an external magnetic material, and in a case in which the thickness is greater than 3 μm, a volume occupied by a magnetic material may be decreased in accordance with an increase in the thickness of the insulating film, such that limitation may be present in increasing inductance.

Figure 3:
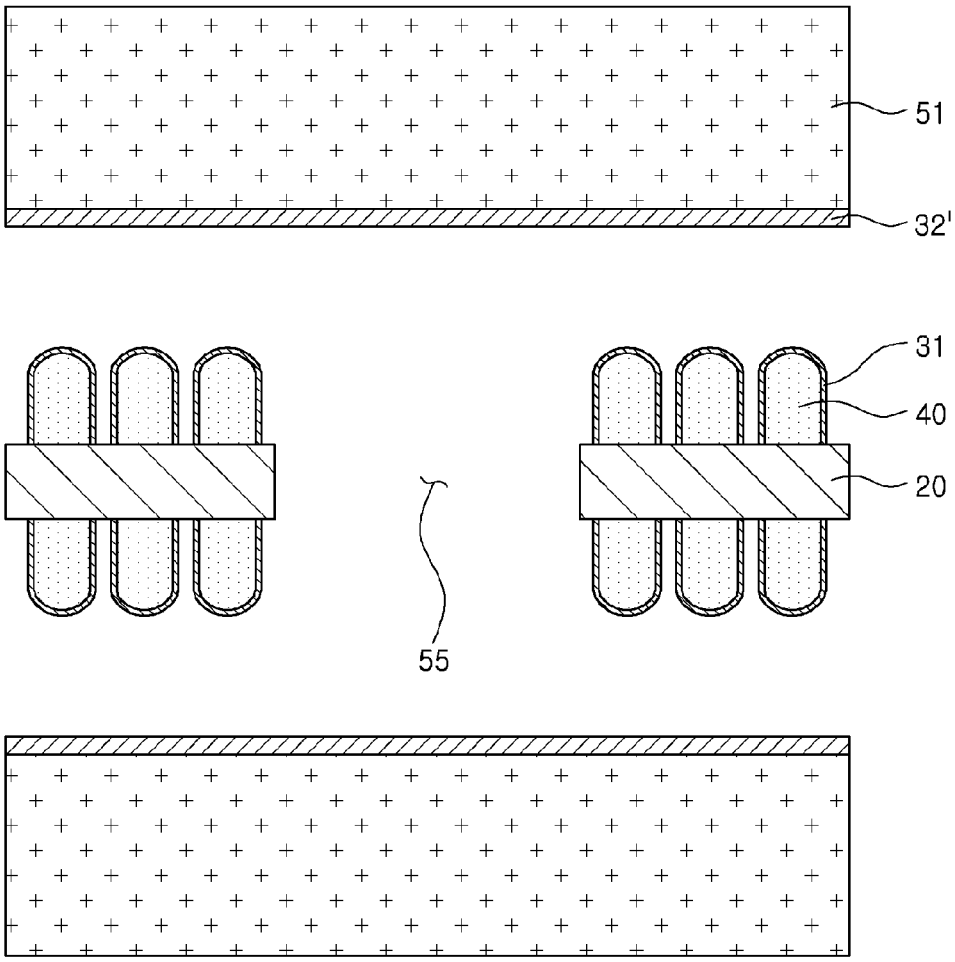

Referring to FIG. 3, a primer insulating layer 32' may be formed on one surface of a magnetic sheet 51, and the magnetic sheet 51 on which the primer insulating layer 32' is formed may be disposed on an upper portion and a lower portion of the insulating substrate 20 on which the coil pattern part 40 is formed and then be pressed.

Therefore, a magnetic body 50 in which an additional insulating film 32 is formed on the coil pattern part 40 on which the thin polymer insulating film 31 is formed may be formed.

In a case in which the thin polymer insulating film 31 is formed to have a small thickness in order to increase a volume filled with a magnetic material, a non-insulating region may be partially formed, thereby causing a defective waveform. Therefore, according to an exemplary embodiment of the present disclosure, since the additional insulating film 32 may be formed on the coil pattern part 40 without a separate additional insulating process by forming the primer insulating layer 32' on one surface of the magnetic sheet 51 and disposing and pressing the magnetic sheet 51 on which the primer insulating layer 32' is formed on the insulating substrate 20, such that a defect caused by non-insulation of the coil may be decreased.

The additional insulating film 32 may be formed on the thin polymer insulating film 31 to follow the surface shape of the coil pattern part 40 during the disposing and pressing process of the magnetic sheet 51 having one surface thereof on which the primer insulating layer 32' is formed.

Since the additional insulating film 32 formed as described above may cover the entirety of the coil pattern part 40, the non-insulating region may be significantly decreased.

The primer insulating layer 32' may be formed of any material without limitations as long as it may be generally used as a material of an insulating film. For example, the primer insulating layer 32' may contain any one or more selected from a group consisting of an epoxy resin, a polyimide resin, a phenoxy resin, a polysulfone resin, a polycarbonate resin, and the like.

Meanwhile, the primer insulating layer 32' may further contain a filler.

Since the primer insulating layer 32' is manufactured in a sheet shape and formed on one surface of the magnetic sheet 51, the filler may be added in order to improve formability of the sheet, or the like.

Insulation performance as well as formability of the primer insulating layer 32' in a sheet form may be improved by adding the filler.

As the filler, any material may be used without limitations as long as it may improve formability and have insulation performance. For example, silica, or the like, may be used.

A thickness of the primer insulating layer 32' may be 1 μm to 5 μm.

Ina case in which the thickness of the primer insulating layer 32' is less than 1 μm, it may be difficult to form the additional insulating film 32 covering the entirety of the coil pattern part 40, such that it may be difficult to significantly decrease the non-insulating region, and in a case in which the thickness of the primer insulating layer 32' is greater than 5 μm, the volume occupied by the magnetic material may be decreased in accordance with an increase in the thickness of the insulating film, such that there may be a limitation in increasing inductance.

The magnetic sheet 51 having one surface thereof on which the primer insulating layer 32' is formed may be stacked on both surfaces of the insulating substrate 20 on which the coil pattern part 40 is formed, and then pressed by a lamination method or an isostatic pressing method. In this case, the through hole 55 may form a core part filled with a magnetic material.

In addition, a magnetic material may fill a region between coil portions of the coil pattern part 40 on which the thin polymer insulating film 31 and the additional insulating film 32 are formed.

Since surfaces of the thin polymer insulating film 31 and the additional insulating film 32 are thinly formed to follow the surface shape of the coil pattern part 40, a space may be formed in the region between the coil portions. The magnetic material may fill the space during the disposing and pressing process of the magnetic layer. As the magnetic material fills the region between the coil portions of the coil pattern part 40, the volume occupied by the magnetic material is increased, such that inductance may be increased in accordance with the increase in the volume of the magnetic material.

Figure 4:
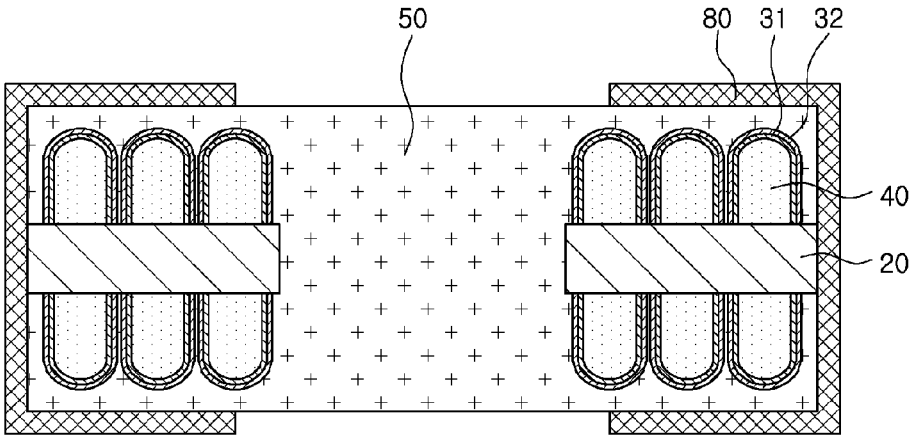

Referring to FIG. 4, an external electrode 80 may be formed to be connected to the coil pattern part 40 exposed to at least one end surface of the magnetic body 50.

The external electrode 80 may be formed using a paste containing a metal having excellent electrical conductivity, and the paste may be a conductive paste containing, for example, nickel (Ni), copper (Cu), tin (Sn), or silver (Ag) alone or an alloy thereof. The external method 80 may be formed by a dipping method, or the like, as well as a printed method according to a shape of the external electrode 80.

Chip Electronic Component

Hereinafter, a chip electronic component according to an exemplary embodiment of the present disclosure will be described. Particularly, a thin type inductor will be described by way of example, but the present disclosure is not limited thereto.

Figure 5:
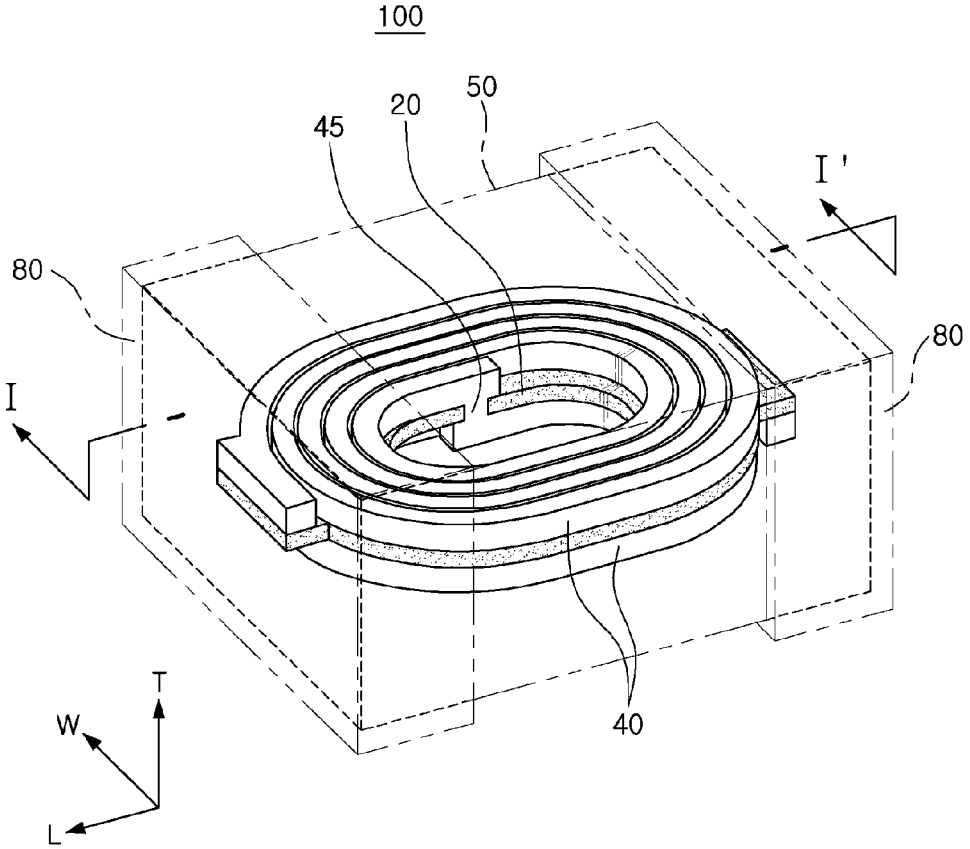
FIG. 5 is a schematic perspective view showing a chip electronic component according to an exemplary embodiment of the present disclosure, in which coil pattern parts are shown.
Figure 6:
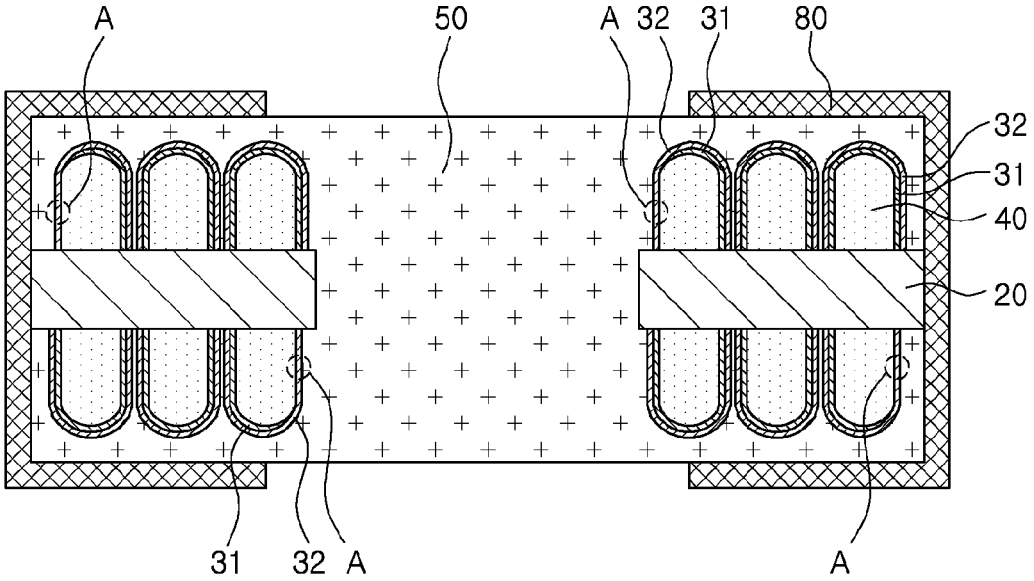
FIG. 6 is a cross-sectional view taken along line I-I' of FIG. 5.

FIG. 5 is a schematic perspective view showing a chip electronic component according to an exemplary embodiment of the present disclosure, in which internal coil parts are shown. FIG. 6 is a cross-sectional view taken along line I-I' of FIG. 5.

Referring to FIGS. 5 and 6, as an example of the chip electronic component, a thin type inductor 100 used in a power line of a power supply circuit is disclosed. As the chip electronic component, a chip bead, a chip filter, or the like, in addition to the chip inductor, may be appropriately used.

The thin type inductor 100 may include the magnetic body 50, the insulating substrate 20, the coil pattern part 40, and the external electrode 80.

The magnetic body 50 may form the exterior of the thin type chip inductor 100 and may be formed of any material capable of exhibiting magnetic properties. For example, the magnetic body 50 may be formed by filling a ferrite material or a metal-based soft magnetic material.

An example of the ferrite material may include ferrite commonly known in the art such as Mn—Zn based ferrite, Ni—Zn based ferrite, Ni—Zn—Cu based ferrite, Mn—Mg based ferrite, Ba based ferrite, Li based ferrite, or the like.

The metal-based soft magnetic material may be an alloy containing at least one selected from a group consisting of Fe, Si, Cr, Al, and Ni. For example, the metal-based soft magnetic material may contain Fe—Si—B—Cr based amorphous metal particles, but is not limited thereto.

The metal-based soft magnetic material may have a particle diameter of 0.1 μm to 30 μm and be contained in a form in which particles are dispersed on a polymer such as an epoxy resin, polyimide, or the like.

The magnetic body 50 may have a hexahedral shape, and a direction of the hexahedron will be defined in order to clearly describe exemplary embodiments of the present disclosure. L, W and T shown in FIG. 5 refer to a length direction, a width direction, and a thickness direction, respectively. The magnetic body 50 may have a rectangular parallelepiped shape in which a length thereof is greater than a width thereof.

The insulating substrate 20 formed in the magnetic body 50 may be, for example, a polypropylene glycol (PPG) substrate, a ferrite substrate, a metal-based soft magnetic material, or the like.

A hole penetrates through the central portion of the insulating substrate 20 to form the through hole 55, and the through hole 55 may be filled with a magnetic material such as a ferrite material or metal-based soft magnetic material, or the like, to thereby form a core part. The core part filled with the magnetic material may be formed, such that inductance L may be improved.

The coil pattern part 40 having a coil-shaped pattern may be formed on one surface of the insulating substrate 20, and the coil pattern part 40 having a coil-shaped pattern may also be formed on the other surface of the insulating substrate 20.

In the coil pattern part 40, the coil pattern may be formed in a spiral shape. The coil pattern part 40 formed on one surface of the insulating substrate 20 and the coil pattern part 40 formed on the other surface of the insulating substrate 20 may be electrically connected to each other through the via electrode 45 formed in the insulating substrate 20.

The coil pattern part 40 and the via electrode 45 may be formed of a metal having excellent electrical conductivity. For example, the coil pattern part 40 and the via electrode 45 may be formed of silver (Ag), palladium (Pd), aluminum (Al), nickel (Ni), titanium (Ti), gold (Au), copper (Cu), platinum (Pt), an alloy thereof, or the like.

The thin polymer insulating film 31 covering the coil pattern part 40 may be formed on a surface of the coil pattern part 40.

A surface of the thin polymer insulating film 31 may be formed to follow a surface shape of the coil pattern part 40. The surface of the thin polymer insulating film 31 may be formed to follow a shape of the surface of the coil pattern part 40, meaning that the surface of the thin polymer insulating film 31 is formed in a similar manner to that of the case, in which the thin polymer insulating film 31 is thinly coated to follow the surface shape of the coil pattern part 40 as shown in FIG. 6.

As described above, the thin polymer insulating film according to an exemplary embodiment of the present disclosure may be formed by a chemical vapor deposition (CVD) method or a dipping method using a low viscosity polymer coating solution.

The thin polymer insulating film 31 may be formed to have a thickness of 3 μm or less, more preferably 1 μm to 3 μm.

In a case in which the thickness of the formed thin polymer insulating film 31 is less than 1 μm, the insulating film may be damaged during a disposing and pressing process of a magnetic layer, such that a defective waveform may occur due to contact between the coil pattern part 40 and an external magnetic material, and in a case in which the thickness is greater than 3 μm, a volume occupied by the magnetic material may be decreased in accordance with an increase in the thickness of the insulating film, such that there may be a limitation in increasing inductance.

The thin polymer insulating film 31 may contain poly(p-xylylene), an epoxy resin, a polyimide resin, a phenoxy resin, a polysulfone resin, a polycarbonate resin, or the like, alone, or mixtures thereof, but is not limited thereto.

The additional insulating film 32 may be formed on the coil pattern part 40 on which the thin polymer insulating film 31 is formed, so as to follow the surface shape of the coil pattern part 40.

In a case in which the thin polymer insulating film 31 is formed to have a small thickness in order to increase a volume filled with the magnetic material, a non-insulating region ('A' of FIG. 6) may be partially formed, thereby causing a defective waveform. Therefore, according to an exemplary embodiment of the present disclosure, the additional insulating film 32 may be formed on the coil pattern part 40 without an additional insulating process by forming the primer insulating layer 32' on one surface of the magnetic sheet 51 and disposing and pressing the magnetic sheet 51.

Since the additional insulating film 32 is formed on the coil pattern part 40 on which the thin polymer insulating film 31 is formed to cover the entirety of the coil pattern part 40, the non-insulating region may be significantly decreased.

The additional insulating film 32 may be formed of any material without limitations as long as it may be generally used as a material of an insulating film. For example, the additional insulating film 32 may contain one or more selected from a group consisting of an epoxy resin, a polyimide resin, a phenoxy resin, a polysulfone resin, a polycarbonate resin, and the like.

Meanwhile, the additional insulating film 32 may further contain a filler.

Since the primer insulating layer 32' is manufactured in a sheet shape and formed on one surface of the magnetic sheet 51, and then the magnetic sheet 51 is disposed and pressed during the formation of the additional insulating film 32, the filler may be added in order to improve formability of the primer insulating layer 32' in a sheet form, or the like.

Insulation performance as well as formability of the primer insulating layer 32' in a sheet form may be improved by adding the filler.

As the filler, any material may be used without limitations as long as it may improve formability and have insulation performance. For example, silica, or the like, may be used.

The thickness of the additional insulating film 32 may be 1 μm to 5 μm.

In a case in which the thickness of the additional insulating film 32 is less than 1 μm, it may be difficult to cover the entirety of the coil pattern part 40, such that it may be difficult to significantly decrease the non-insulating region, and in a case in which the thickness of the additional insulating film 32 is greater than 5 μm, a volume occupied by the magnetic material may be decreased in accordance with an increase in the thickness of the insulating film, such that there may be a limitation in increasing inductance.

Meanwhile, the magnetic material may fill a region between the coil portions of the coil pattern part 40 on which the thin polymer insulating film 31 and the additional insulating film 32 are formed.

Since surfaces of the thin polymer insulating film 31 and the additional insulating film 32 are thinly formed to follow the surface shape of the coil pattern part 40, a space may be formed in the region between the coil portions. The magnetic material may fill the space during the disposing and pressing process of the magnetic layer. As the magnetic material fills the region between the coil portions of the coil pattern part 40, the volume occupied by the magnetic material is increased, such that inductance may be increased in accordance with the increase in the volume of the magnetic material.

Other features overlapped with those of the manufacturing method of a chip electronic component according to the foregoing exemplary embodiment of the present disclosure will be omitted.

As set forth above, with the chip electronic component and the manufacturing method thereof according to exemplary embodiments of the present disclosure, the non-insulation defect caused by formation of the thin insulating layer may be decreased without a separate additional insulating process.

Therefore, a simplified process may be enabled, and a defective waveform at high frequency caused by the non-insulation region of the coil may be prevented. Further, since the thin insulating layer is formed, inductance of the inductor, or the like, may be improved.

While exemplary embodiments have been shown and described above, it will be apparent to those skilled in the art that modifications and variations could be made without departing from the spirit and scope of the present disclosure as defined by the appended claims.

What is claimed is:

1. A manufacturing method of a chip electronic component, the manufacturing method comprising:

forming a coil pattern part on at least one surface of an insulating substrate;

forming a thin polymer insulating film to follow a surface shape of the coil pattern part;

forming a first primer insulating layer on one surface of a first magnetic sheet, and forming a second primer insulating layer on one surface of a second magnetic sheet;

after forming the first primer insulating layer on the one surface of the first magnetic sheet and forming the second primer insulating layer on the one surface of the second magnetic sheet, interposing the insulating substrate on which the coil pattern part is formed between the first and second magnetic sheets such that the first and second primer insulating layers are facing each other, and pressing the first and second magnetic sheets to form a magnetic body such that the first and second primer insulating layers are converted to additional insulating films on the coil pattern part; and forming an external electrode on at least one end surface of the magnetic body so as to be connected to the coil pattern part.

2. The manufacturing method of claim 1, wherein the additional insulating films follow the surface shape of the coil pattern part on the thin polymer insulating film.

3. The manufacturing method of claim 1, wherein the additional insulating films covers the entirety of the coil pattern part on which the thin polymer insulating film is formed.

4. The manufacturing method of claim 1, wherein the thin polymer insulating film is formed by a chemical vapor deposition (CVD) method.

5. The manufacturing method of claim 1, wherein the thin polymer insulating film contains one or more selected from a group consisting of poly(p-xylylene), an epoxy resin, a polyimide resin, a phenoxy resin, a polysulfone resin, and a polycarbonate resin.

6. The manufacturing method of claim 1, wherein each of the first and second primer insulating layers contains one or more selected from a group consisting of an epoxy resin, a polyimide resin, a phenoxy resin, a polysulfone resin, and a polycarbonate resin.

7. The manufacturing method of claim 1, wherein each of the first and second primer insulating layers contains a filler.

8. The manufacturing method of claim 1, wherein the thin polymer insulating film has a thickness of 1 μm to 3 μm.

9. The manufacturing method of claim 1, wherein each of the first and second primer insulating layers has a thickness of 1 μm to 5 μm.

10. The manufacturing method of claim 1, wherein a magnetic material fills a region between coil portions of the coil pattern part on which the thin polymer insulating film and the additional insulating film are formed.

11. The manufacturing method of claim 1, wherein patterns that constitute the coil pattern part are in contact with the insulating substrate, and the insulating substrate is a single integral substrate.

* * * * *